US009104145B2

(12) United States Patent
Okabayashi et al.

(10) Patent No.: US 9,104,145 B2
(45) Date of Patent: Aug. 11, 2015

(54) FIXING DEVICE HAVING A SLIDING SHEET OF CROSS-LINKED PTFE

(71) Applicant: FUJI XEROX CO., LTD., Tokyo (JP)

(72) Inventors: Yasuto Okabayashi, Kanagawa (JP); Kenji Omori, Kanagawa (JP); Toshiyuki Miyata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/136,756

(22) Filed: Dec. 20, 2013

(65) Prior Publication Data

US 2014/0341622 A1 Nov. 20, 2014

(30) Foreign Application Priority Data

May 14, 2013 (JP) ..... 2013-102604

(51) Int. Cl.
*G03G 15/20* (2006.01)

(52) U.S. Cl.
CPC ..... *G03G 15/2028* (2013.01); *G03G 15/2053* (2013.01); *G03G 15/206* (2013.01); *G03G 2215/2035* (2013.01)

(58) Field of Classification Search
CPC ..... G03G 15/206; G03G 15/2028; G03G 15/2053; G03G 2215/2035
USPC ..... 399/328–329, 333; 219/216
See application file for complete search history.

(56) References Cited

U.S. PATENT DOCUMENTS 6,801,744 B2 * 10/2004 Fujiwara et al. ..... 399/328
6,895,208 B2 * 5/2005 Nakatogawa et al. ..... 399/329
7,056,636 B2 * 6/2006 Tomita et al. ..... 430/108.4
7,177,580 B2 * 2/2007 Nakafuji et al. ..... 399/328
7,488,528 B2 * 2/2009 Iwamoto ..... 428/141
7,917,073 B2 * 3/2011 Miyata et al. ..... 399/329
2006/0216077 A1 * 9/2006 Komuro ..... 399/328
2009/0014942 A1 * 1/2009 Okuno ..... 271/4.06

(Continued)

FOREIGN PATENT DOCUMENTS

JP A-2003-167468 6/2003
JP A-2004-206105 7/2004

(Continued)

OTHER PUBLICATIONS

Translation of Mar. 11, 2014 Office Action issued in Japanese Patent Application No. 2013-102604.

*Primary Examiner* — Clayton E LaBalle
*Assistant Examiner* — Trevor J Bervik
(74) *Attorney, Agent, or Firm* — Oliff PLC

(57) ABSTRACT

A fixing device includes a heating member that heats a toner image on a recording medium and includes a rotatable belt member, a heat source, a pressing member, a sliding sheet, and a pressure-applying member. The pressing member presses the belt member against the pressure-applying member. A surface of the pressing member that opposes the belt member includes a flat portion or a recessed portion having a radius of curvature of approximately 100 mm or more. The sliding sheet is disposed between the belt member and the pressing member and includes a sliding layer containing cross-linked polytetrafluoroethylene, the content of which in resin contained in the layer is approximately 25 mass % or more and approximately 75 mass % or less. The pressure-applying member presses the recording medium against the belt member and rotates to transport the recording medium while nipping it between itself and the belt member.

2 Claims, 6 Drawing Sheets

(56) References Cited

U.S. PATENT DOCUMENTS

| | | | | |
|---|---|---|---|---|
| 2009/0208264 | A1* | 8/2009 | Fujiwara et al. | 399/329 |
| 2011/0229227 | A1* | 9/2011 | Yoshikawa et al. | 399/329 |
| 2012/0121304 | A1* | 5/2012 | Tokuda et al. | 399/329 |
| 2012/0328343 | A1* | 12/2012 | Kunii et al. | 399/341 |
| 2013/0034374 | A1 | 2/2013 | Ohtsu et al. | |

FOREIGN PATENT DOCUMENTS

| | | |
|---|---|---|
| JP | A-2006-178119 | 7/2006 |
| JP | A-2007-292949 | 11/2007 |
| JP | A-2008-96929 | 4/2008 |
| JP | A-2013-33107 | 2/2013 |
| JP | A-2013-44817 | 3/2013 |

* cited by examiner

FIXING DEVICE HAVING A SLIDING SHEET OF CROSS-LINKED PTFE

CROSS-REFERENCE TO RELATED APPLICATIONS

This application is based on and claims priority under 35 USC 119 from Japanese Patent Application No. 2013-102604 filed May 14, 2013.

BACKGROUND

Technical Field

The present invention relates to a fixing device and an image forming apparatus.

SUMMARY

A fixing device according to an aspect of the invention includes a heating member that heats a toner image formed on a recording medium. The heating member includes a rotatable belt member, a heat source, a pressing member, a sliding sheet, and a pressure-applying member. The pressing member is disposed inside the belt member and presses the belt member against the pressure-applying member. A surface of the pressing member that opposes an inner peripheral surface of the belt member with the sliding sheet interposed therebetween includes a flat portion or a recessed portion having a radius of curvature of approximately 100 mm or more. The sliding sheet is disposed between the belt member and the pressing member and includes a sliding layer containing cross-linked polytetrafluoroethylene. The content of the cross-linked polytetrafluoroethylene in resin contained in the sliding layer is in the range of approximately 25 mass % or more and approximately 75 mass % or less. The pressure-applying member presses the recording medium against the belt member and rotates in response to rotation of the belt member to transport the recording medium while nipping the recording medium between the pressure-applying member and the belt member.

BRIEF DESCRIPTION OF THE DRAWINGS

Exemplary embodiments of the present invention will be described in detail based on the following figures, wherein.

DETAILED DESCRIPTION

A fixing device and an image forming apparatus according to an exemplary embodiment of the present invention will be described with reference to the drawings. In each figure, the direction of arrow X corresponds to the rightward direction when the image forming apparatus is viewed from the front. Similarly, the direction of arrow −X corresponds to the leftward direction, the direction of arrow Y to the upward direction, the direction of arrow −Y to the downward direction, the direction of arrow Z to the backward direction, and the direction of arrow −Z to the forward direction.

Overall Structure

Figure 6:
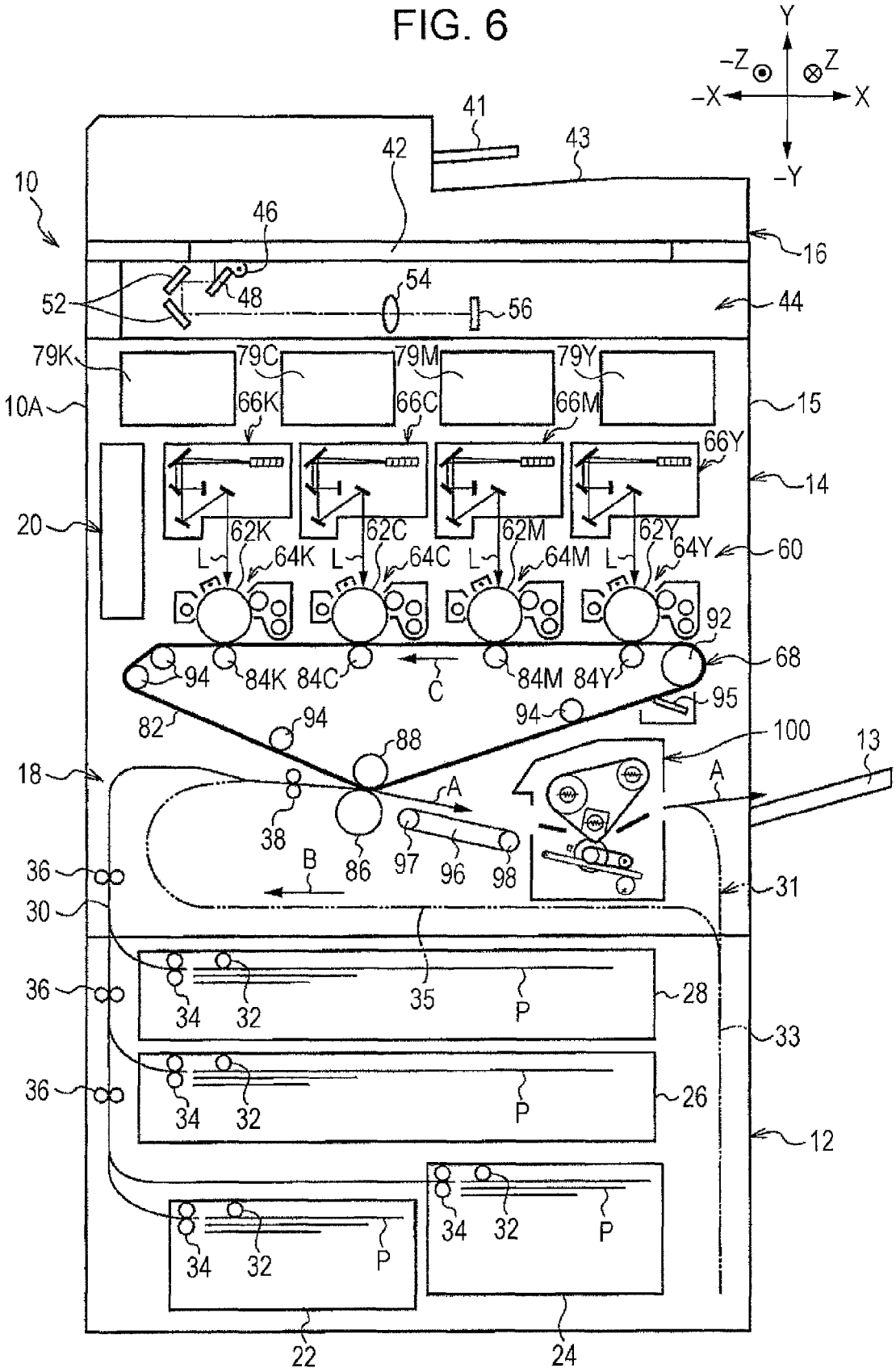
FIG. 6 is a schematic diagram illustrating the image forming apparatus according to the exemplary embodiment of the present invention.

Referring to FIG. 6, an image forming apparatus 10 includes, in order from bottom to top in the vertical direction (direction of arrow Y), a sheet container unit 12 which contains sheet members P, which are an example of recording media; an operation unit 14 which is located above the sheet container unit 12 and forms images on the sheet members P fed from the sheet container unit 12; a document reading unit 16 which is located above the operation unit 14 and reads a document (not shown); a transport unit 18 that transports the sheet members P to each part; and a controller 20 that is provided in the operation unit 14 and controls the operation of each part of the image forming apparatus 10. The image forming apparatus 10 also includes an apparatus body 10A, which includes plural frame members, as a housing.

Sheet Container Unit

The sheet container unit 12 includes a first container 22, a second container 24, a third container 26, and a fourth container 28 that are capable of containing sheet members P having different sizes. Each of the first container 22, the second container 24, the third container 26, and the fourth container 28 is equipped with a feeding roller 32 that feeds the contained sheet members P one at a time and transport rollers 34 that transport the sheet members P that have been fed to a transport path 30 provided in the image forming apparatus 10.

Transport Unit

The transport unit 18 is disposed downstream of the transport rollers 34 along the transport path 30, and includes plural transport rollers 36 that transport the sheet members P one at a time. Positioning rollers 38 are disposed downstream of the transport rollers 36 in a transporting direction of the sheet members P. The positioning rollers 38 temporarily stop each sheet member P and feed the sheet member P toward a second transfer position, which will be described below, at a predetermined timing to determine an image transferring position.

In front view of the image forming apparatus 10, an upstream portion of the transport path 30 linearly extends in the direction of arrow Y from the side of the sheet container unit 12 in the −X direction to a lower portion of the side of the operation unit 14 in the −X direction. A downstream portion of the transport path 30 extends from the lower portion of the side of the operation unit 14 in the −X direction to a paper ejection unit 13 arranged at a lower portion of the side of the operation unit 14 in the X direction.

A duplex-image-formation transport path 31, which is provided for reversing and transporting the sheet member P to form images on both sides of the sheet member P, is connected to the transport path 30. Arrow A shows the transporting direction of the sheet member P in the case where duplex image formation is not performed.

In front view of the image forming apparatus 10, the duplex-image-formation transport path 31 includes a reversing unit 33 and a transporting unit 35. The reversing unit 33 extends linearly in the direction of arrow Y from the lower portion of the side of the operation unit 14 in the X direction to the side of the sheet container unit 12 in the X direction. The transporting unit 35 receives the trailing end of the sheet member P that has been transported to the reversing unit 33 and transports the sheet member P in the direction of arrow −X (shown by arrow B). The downstream end of the transporting unit 35 is connected to the transport path 30 by a guiding member (not shown) at a position upstream of the positioning rollers 38 on the transport path 30. In FIG. 6, a switching member for switching between the transport path 30 and the duplex-image-formation transport path 31 and a switching member for switching between the reversing unit 33 and the transporting unit 35 are not illustrated.

Document Reading Unit

The document reading unit 16 includes a document tray 41 capable of receiving plural document sheets (not shown); a platen glass 42 on which a single document sheet may be placed; a document reading device 44 that reads the document sheet placed on the platen glass 42; and a document ejection unit 43 to which the document sheets are ejected after being read.

The document reading device 44 includes a light emitting unit 46, a single full-rate mirror 48, two half-rate mirrors 52, an imaging lens 54, and a photoelectric converter 56. The light emitting unit 46 emits light toward the document sheet placed on the platen glass 42. The light emitted from the light emitting unit 46 and reflected by the document sheet is reflected in a direction parallel to the platen glass 42 by the full-rate mirror 48 and the half-rate mirrors 52. The light reflected by the full-rate mirror 48 and the half-rate mirrors 52 is incident on the imaging lens 54. The reflected light is focused by the imaging lens 54, and is converted into an electrical signal by the photoelectric converter 56.

The electrical signal obtained by the photoelectric converter 56 is subjected to image processing performed by an image processing device (not shown) and is used in an image forming operation. The full-rate mirror 48 moves at a full rate along the platen glass 42, and the half-rate mirrors 52 move at a half rate along the platen glass 42.

Operation Unit

The operation unit 14 includes an image forming section 60 and a fixing device 100. The image forming section 60 forms toner images on the sheet member P. The fixing device 100 fixes the toner images formed on the sheet member P by the image forming section 60 to the sheet member P by applying heat and pressure.

Image Forming Section

The image forming section 60 includes image forming units 64K, 64C, 64M, and 64Y including image carries 62K, 62C, 62M, and 62Y that correspond to yellow (Y), magenta (M), cyan (C), and black (K) toners; exposure units 66K, 66C, 66M, and 66Y that perform an exposure process by emitting light beams L toward the outer peripheral surfaces of the image carries 62K, 62C, 62M, and 62Y; and a transfer unit 68 that transfers the toner images formed by the image forming units 64K, 64C, 64M, and 64Y onto the sheet member P.

In the following description, reference numerals with one of the characters Y, M, C, and K attached thereto are used when components corresponding to Y, M, C, and K are to be distinguished from each other, and the characters Y, M, C, and K will be omitted when components corresponding to Y, M, C, and K have similar structures and it is not necessary to distinguish the components from each other.

Exposure Units (Image Forming Section)

Each exposure unit 66 deflects a light beam emitted from a light source (not shown) with a rotating polygon (polygon mirror), which is not denoted by a reference numeral, and reflects the light beam with plural optical elements including reflecting mirrors, thereby emitting a light beam L that corresponds to the toner of the corresponding color toward the corresponding image carrier 62. The image carrier 62 is located below (on the −Y direction side of) the exposure unit 66.

Image Forming Units (Image Forming Section)

Figure 5:
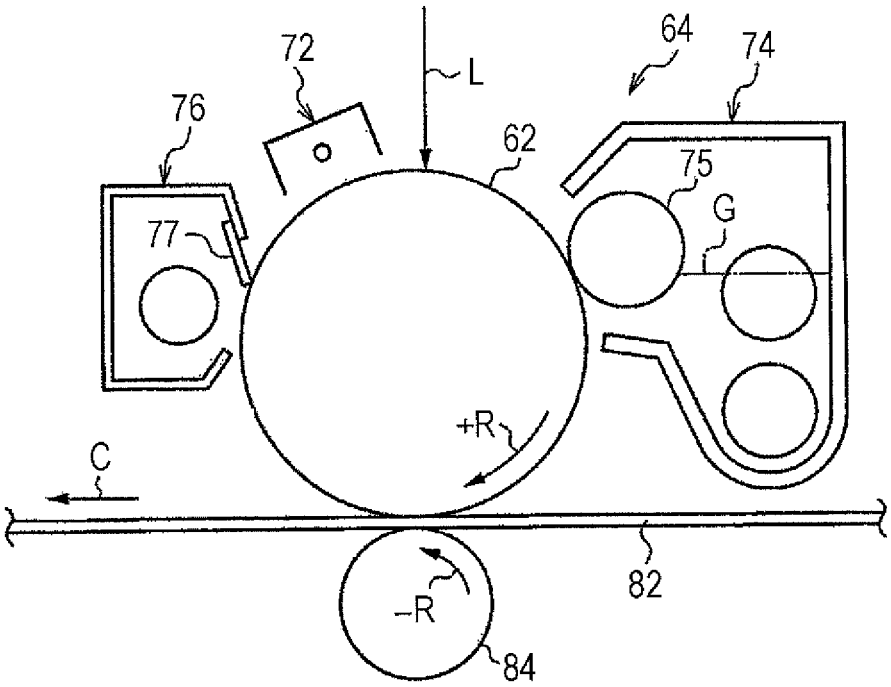
FIG. 5 is a side view of an image forming unit included in an image forming apparatus according to the exemplary embodiment of the present invention.

As illustrated in FIG. 5, each image forming unit 64 includes the image carrier 62 having a columnar shape and capable of rotating in the direction of arrow +R (clockwise in FIG. 5). Each image forming unit 64 also includes a charging device 72, a developing device 74, and a cleaning member 76, which are arranged in the rotating direction of the image carrier 62 from the upstream side to the downstream side so as to face the outer peripheral surface of the image carrier 62.

The charging device 72 and the developing device 74 are arranged such that the outer peripheral surface of the image carrier 62 is irradiated with the laser beam L at a position between the charging device 72 and the developing device 74. An intermediate transfer belt 82, which will be described below, is in contact with the outer peripheral surface of the image carrier 62 at a position between the developing device 74 and the cleaning member 76.

The image carrier 62 is rotatable in the direction of arrow +R by a motor (not shown). The charging device 72 is, for example, a corotron charging unit that charges the outer peripheral surface of the image carrier 62 to a potential having the same polarity as that of the toner by applying a voltage to a wire and generating a corona discharge. The charged outer peripheral surface of the image carrier 62 is irradiated with the laser beam L on the basis of the image data, so that a latent image (electrostatic latent image) is formed.

The developing device 74 may contain developer G, which is a mixture of carrier particles made of magnetic substance and toner charged to a negative potential, and include a cylindrical developing sleeve 75. A magnet roller (not shown) having plural magnetic poles arranged in the circumferential direction thereof is disposed in the developing sleeve 75. A magnetic brush is formed in a region where the developing device 74 opposes the image carrier 62 when the developing sleeve 75 is rotated. The developing device 74 is configured such that when a developing bias is applied to the developing sleeve 75 by a voltage applying unit (not shown), the latent image on the outer peripheral surface of the image carrier 62 is developed with the toner so that a toner image (developer image) is formed. Each developing device 74 receives toner from a corresponding toner cartridge 79 (see FIG. 6) that is disposed above the image forming section 60.

The cleaning member 76 includes a cleaning blade 77 that contacts the outer peripheral surface of the image carrier 62. The toner that remains on the outer peripheral surface of the image carrier 62 is scraped off by the cleaning blade 77 and collected. The intermediate transfer belt 82, onto which the toner image developed by the developing device 74 is transferred in a first transfer process, is disposed downstream of the developing device 74 in the rotating direction of the image carrier 62.

Transfer Unit (Image Forming Section)

As illustrated in FIG. 6, the transfer unit 68 includes the endless intermediate transfer belt 82; first transfer rollers 84 that transfer the toner images onto the intermediate transfer belt 82 from the image carriers 62 in the first transfer process; and a second transfer roller 86 and an auxiliary roller 88 that transfer the toner images that are superposed on the intermediate transfer belt 82 onto the sheet member P in a second transfer process.

A drive roller 92 that is rotationally driven and plural rotatable transport rollers 94 are arranged inside the intermediate transfer belt 82. The intermediate transfer belt 82 is wrapped around the first transfer rollers 84K, 84C, 84M, and 84Y, the drive roller 92, the transport rollers 94, and the auxiliary roller 88. When the drive roller 92 rotates counterclockwise in FIG. 6, the intermediate transfer belt 82 rotates in the direction of arrow C (counterclockwise in FIG. 6).

Each first transfer roller 84 includes, for example, a columnar shaft made of a metal, such as stainless steel, and an elastic layer (not shown) provided around the shaft. The first transfer roller 84 is supported by bearings at both ends thereof, and is therefore rotatable. The shaft of the first transfer roller 84 receives a voltage having the polarity opposite to that of the toner (positive voltage) from a power supply (not shown).

The second transfer roller 86 has, for example, a structure similar to that of the first transfer rollers 84. The second transfer roller 86 is rotatable and is disposed downstream of the positioning rollers 38 on the transport path 30. The second transfer roller 86 contacts the outer peripheral surface of the intermediate transfer belt 82 at a second transfer position so as to sandwich the intermediate transfer belt 82 between itself and the auxiliary roller 88.

The second transfer roller 86 is grounded. The auxiliary roller 88 serves as a counter electrode for the second transfer roller 86. A second transfer voltage is applied to the auxiliary roller 88 from a feeding roller (not shown) made of a metal that is in contact with the outer peripheral surface of the auxiliary roller 88. The second transfer voltage (negative voltage) is applied to the auxiliary roller 88 so that a potential difference is generated between the auxiliary roller 88 and the second transfer roller 86. Accordingly, the second transfer process is performed in which the toner images on the intermediate transfer belt 82 are transferred onto the sheet member P that has been transported to the contact portion between the second transfer roller 86 and the intermediate transfer belt 82.

A transport belt 96 is disposed downstream of the second transfer roller 86 in the transporting direction of the sheet member P. The transport belt 96 transports the sheet member P on which the toner images have been transferred in the second transfer process to the fixing device 100. The transport belt 96 is wrapped around a support roller 97 and a drive roller 98, and rotates to transport the sheet member P to the fixing device 100.

Fixing Device

Figure 4:
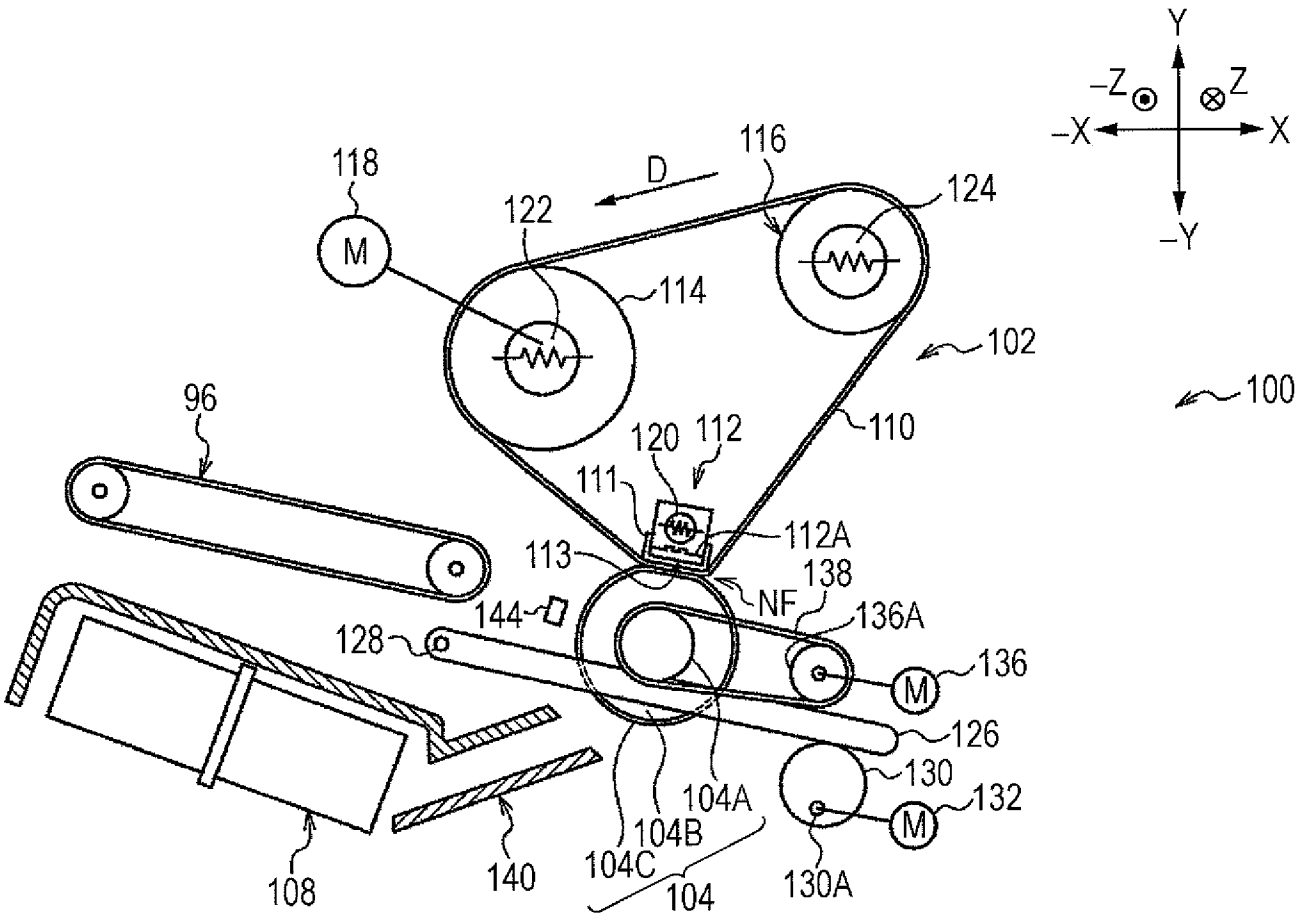
FIG. 4 is a side view of the fixing device according to the exemplary embodiment of the present invention.

The fixing device 100 includes a heating belt mechanism 102 and a pressure-applying roller 104 (see FIG. 4). The heating belt mechanism 102 is an example of a heating member that heats the toner images that have been transferred onto (formed on) the sheet member P. The pressure-applying roller 104 is an example of a pressure-applying member that presses the sheet member P that is being transported against a fixing belt 110 included in the heating belt mechanism 102. The fixing device 100 will be described in detail below.

Operation of Overall Structure

The operation according to the present exemplary embodiment will now be described.

Referring to FIG. 5, in an operation of forming an image on a sheet member P, each image carrier 62 is charged by the corresponding charging device 72 and is irradiated with the laser beam L emitted from the corresponding exposure unit 66 in accordance with the image data, so that an electrostatic latent image is formed on the image carrier 62.

The electrostatic latent images formed on the outer peripheral surfaces of the image carriers 62 are developed by the respective developing devices 74 into yellow (Y), magenta (M), cyan (C), and black (K) toner images.

Referring to FIG. 6, the toner images formed on the surfaces of the image carriers 62 are successively transferred onto the intermediate transfer belt 82 in a superposed manner by the respective first transfer rollers 84 at the first transfer positions. The toner images that have been transferred onto the intermediate transfer belt 82 in a superposed manner are transferred onto the sheet member P, which has been transported along the transport path 30, by the second transfer roller 86 and the auxiliary roller 88 at the second transfer position in the second transfer process.

The sheet member P onto which the toner images have been transferred is transported toward the fixing device 100 by the transport belt 96. The fixing device 100 fixes the toner images to the sheet member P by applying heat and pressure. The sheet member P having the toner images fixed thereto is, for example, ejected to the paper ejection unit 13. Thus, the image forming operation is performed.

In the case where toner images are to be formed on an image-free surface of the sheet member P on which no image has been formed (in case of duplex image formation), after the images are fixed to the front surface by the fixing device 100, the sheet member P is transported to the duplex-image-formation transport path 31. Then, images are formed on and fixed to the back surface of the sheet member P.

Structure of Fixing Device

The structure of the fixing device 100 will now be described.

As described above, the fixing device 100 includes the heating belt mechanism 102 that heats the toner images that have been transferred onto the sheet member P and the pressure-applying roller 104 that presses the transported sheet member P against the heating belt mechanism 102. The fixing device 100 also includes a fan 108 that blows air toward the surface (outer peripheral surface) of the pressure-applying roller 104.

Heating Belt Mechanism: Fixing Device

Referring to FIG. 4, the heating belt mechanism 102 includes the endless fixing belt 110, which is an example of a rotatable belt member, halogen lamps 120 to 124, which are examples of heat sources, a pad member 112, which is an example of a pressing member and extends in the Z direction, and a sliding sheet 111. The heating belt mechanism 102 also includes a roller member 114 and a roller member 116 that have rotation axes extending in the Z direction and that are separated from each other in the X direction.

The fixing belt 110 is wrapped around the pad member 112, the roller member 114, and the roller member 116 so that the position thereof is maintained.

More specifically, the pad member 112 is disposed inside the fixing belt 110 so as to press the fixing belt 110 against the pressure-applying roller 104. The sliding sheet 111 is disposed between the fixing belt 110 and the pad member 112. Although not illustrated, the sliding sheet 111 is provided on the pad member 112 such that the sliding sheet 111 is fixed (for example, retained by retaining plates) at the ends thereof in the width direction. Namely, the sliding sheet 111 is fixed to the pad member 112 at both ends thereof in the width direction and is not fixed to the pad member 112 in a central region thereof in the width direction.

The pad member 112 includes a pressing portion 112A that presses the fixing belt 110 against the pressure-applying roller 104. In other words, the pad member 112 (the pressing portion 112A thereof) has a nip forming surface 113 that is pressed by the pressure-applying roller 104 through the sliding sheet 111 and the fixing belt 110. The nip forming surface 113 receives a nip load (pressing load) from the pressure-applying roller 104, so that a fixing nip NF, which is a pressing portion, is formed between the fixing belt 110 and the pressure-applying roller 104.

Figure 2A:
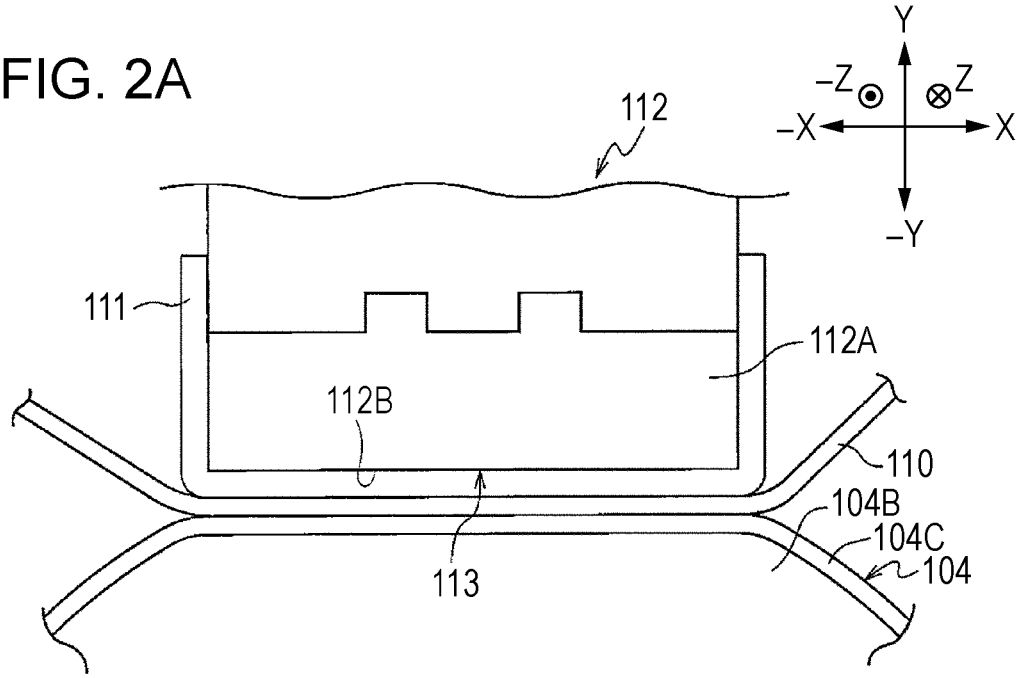
FIGS. 2A and 2B are enlarged side views of a part of the fixing nip portion of the fixing device according to the exemplary embodiment of the present invention.

A surface of the pressing portion 112A of the pad member 112 that opposes the inner peripheral surface of the fixing belt 110 with the sliding sheet 111 interposed therebetween (that is, the nip forming surface 113) has a flat portion 112B (see FIG. 2A). More specifically, in the state in which the pad member 112 and the pressure-applying roller 104 are pressed against each other with the sliding sheet 111 and the fixing belt 110 interposed therebetween, the pressure-applying roller 104 is compressed and the nip forming surface 113 of the pressing portion 112A (a portion of the nip forming surface 113 excluding the ends thereof in the X direction) has the flat portion 112B.

Figure 2B:
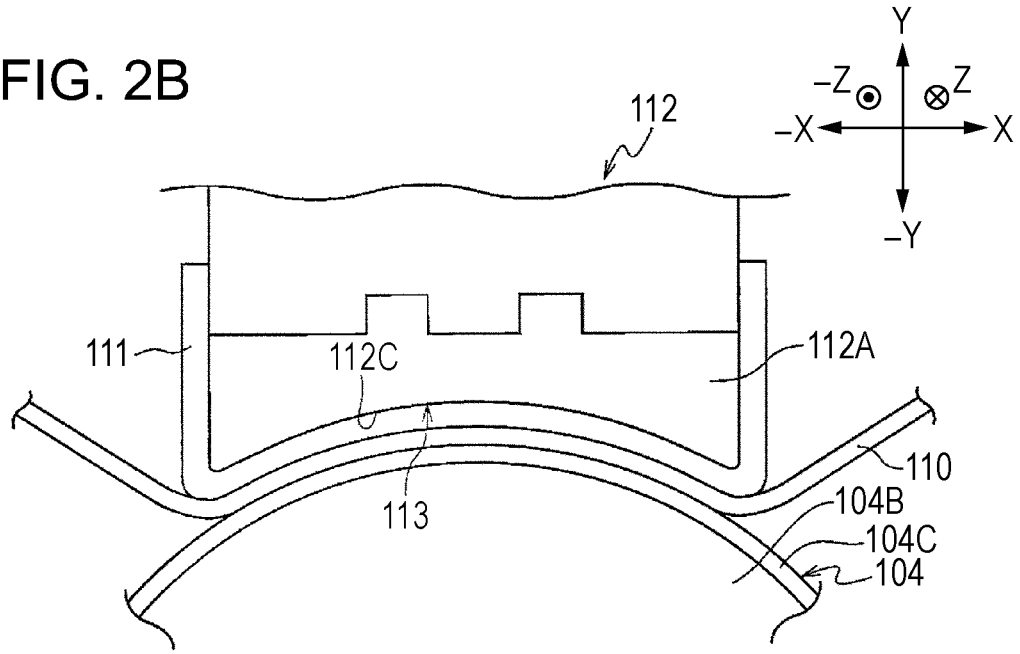

The nip forming surface 113 of the pressing portion 112A may instead have a recessed portion 112C having a radius of curvature of 100 mm or more or approximately 100 mm or more (see FIG. 2B). More specifically, in the state in which the pad member 112 and the pressure-applying roller 104 are pressed against each other with the sliding sheet 111 and the fixing belt 110 interposed therebetween, the pressing portion 112A is compressed and the nip forming surface 113 of the pressing portion 112A (a portion of the nip forming surface 113 excluding the ends thereof in the X direction) has the recessed portion 1120. The recessed portion 112C is curved along the outer peripheral surface of the pressure-applying roller 104 with a radius of curvature of 100 mm or more or approximately 100 mm or more (preferably 130 mm or more) when viewed in the Z direction. The recessed portion 1120 may be formed when the pad member 112 and the pressure-applying roller 104 are pressed against each other and the pressing portion 112A of the pad member 112 is compressed. Alternatively, the recessed portion 112C may be formed in the pressing portion 112A of the pad member 112 in advance (when the pressure is not applied).

The halogen lamp 120, which is a heat source, is disposed in the pad member 112. The pad member 112 transmits the heat generated by the halogen lamp 120 to the fixing belt 110 through the nip forming surface 113 and the sliding sheet 111.

As illustrated in FIG. 4, the roller member 114 is disposed on the Y direction side and −x direction side of the pad member 112. The halogen lamp 122, which is a heat source, is disposed in the roller member 114. The roller member 114 transmits the heat generated by the halogen lamp 122 to the fixing belt 110. A rotating shaft of the roller member 114 receives a driving force (rotating force) from a motor 118. When the roller member 114 rotates, the fixing belt 110 is rotated in the direction of arrow D.

The roller member 116 is disposed on the X direction side of the roller member 114. The halogen lamp 124, which is a heat source, is disposed in the roller member 116. The roller member 116 transmits the heat generated by the halogen lamp 124 to the fixing belt 110.

The sliding sheet 111 includes a sliding layer having a surface (sliding surface) that slides along the fixing belt 110. The sliding sheet 111 may further include additional layers.

In other words, the sliding sheet 111 may, for example, have a single layer structure including only the sliding layer, a two-layer structure including a base and the sliding layer provided on one side of the base, or a three-layer structure including a base, the sliding layer provided on one side of the base, and a resin layer provided on the other side of the base.

The sliding layer is a single-layer body containing cross-linked polytetrafluoroethylene (hereinafter referred to as "cross-linked PTFE"). More specifically, the sliding layer is a single-layer body containing the cross-linked PTFE and another heat-resistant resin. The sliding layer may further contain a commonly known additive in addition to the resin.

The cross-linked PTFE may be obtained by, for example, irradiating non-cross-linked PTFE with ionizing radiation. More specifically, the cross-linked PTFE may be obtained by, for example, heating non-cross-linked PTFE to a temperature higher than the crystalline melting point and irradiating the non-cross-linked PTFE with ionizing radiation (for example, γ rays, electron rays, X rays, neutron rays, or high-energy ions) at an exposure of 1 KGy or more and 10 MGy or less in an oxygen free environment, thereby cross-linking the non-cross-linked PTFE. The cross-linked PTFE may instead be PTFE that is cross-linked in a combining process.

The content of cross-linked PTFE with respect to the resin in the sliding layer may be 25 mass % or more and 75 mass % or less, or approximately 25 mass % or more and approximately 75 mass % or less (preferably, 35 mass % or more and 65 mass % or less, and more preferably, 40 mass % or more and 60 mass % or less). The content of the cross-linked PTFE may instead be 25 mass % of more and 45 mass % or less, or 55 mass % or more and 75 mass % or less.

When the content of the cross-linked PTFE is in one of the above-described ranges, creeping (stretching) of the sliding sheet 111 (sliding layer) due to sliding along the fixing belt 110 may be suppressed. More specifically, when the content of the cross-linked PTFE is 25 mass % or more, creeping of the sliding sheet 111 (sliding layer) may be suppressed. When the content of the cross-linked PTFE is 75 mass % or less, creeping of the sliding sheet 111 (sliding layer) may be suppressed while ensuring sufficient processability and formability of the cross-linked PTFE. In addition, when the content of the cross-linked PTFE is 75 mass % or less, the occurrence of interface defects at the sliding surface of the sliding sheet 111 (sliding layer) may be easily reduced.

The cross-linked PTFE may contain a copolymer component other than tetrafluoroethylene. In this case, the content of the copolymer component other than tetrafluoroethylene in the total amount of copolymer components of the cross-linked PTFE may be 10 mass % or less. The copolymer component other than tetrafluoroethylene may be, for example, perfluoro (alkylvinylether), hexafluoropropylene, (perfluoroalkyl) ethylene, or chlorotrifluoroethylene.

The other heat-resistant resin may be, for example, thermosetting polyimide, thermoplastic polyimide, polyamide, polyamide-imide, silicone resin, or a fluorocarbon resin other than the cross-linked PTFE. The fluorocarbon resin other than the cross-linked PTFE may be, for example, non-cross-linked polytetrafluoroethylene (hereinafter referred to as "non-cross-linked PTFE"), perfluoroalkoxyalkane (PFA), tetrafluoroethylene/hexafluoropropylene copolymer (FEP), or ethylene/tetrafluoroethylene copolymer (ETFE).

Among these, the other heat-resistant resin may be a fluorocarbon resin, in particular, non-cross-linked PTFE.

The additive may be, for example, a commonly known additive such as a filler.

The filler may be, for example, a lubrication filler having a layered structure (e.g., molybdenum disulfide, hexagonal boron nitride, mica, graphite, tungsten disulfide, or talc), a conductive filler (e.g., carbon black or black lead), a filler containing a heat-resistant resin (e.g., a filler such as polyimide, liquid crystal polymer, or aramid in which the heat-resistant resin is selected from an imide-based resin, an amide-based resin, and an aromatic polyester based resin).

The filler may be a reinforcing filler having a needle-shaped, fiber-shaped, or tetrapod-shaped structure from the viewpoint of increasing the strength of the sliding sheet 111 (sliding layer). Although a single type of filler may be used, two or more types of fillers may instead be used in combination to achieve plural functions.

The content of the filler in the total amount of resin component may be 1.0 mass % or more and 30.0 mass % or less.

The thickness of the sliding layer is set in accordance with the presence or absence and property of the base. When the sliding sheet 111 includes only the sliding layer, the thickness of the sliding layer may be, for example, 100 μm or more and 500 μm or less. When the sliding sheet 111 includes the base, the thickness of the sliding layer may be, for example, 10 μm or more and 100 μm or less.

The base is sheet shaped and is formed of, for example, woven or nonwoven fabric made of glass fiber or resin fiber, or a resin sheet made of a resin.

The resin may be, for example, polyimide resin, polyamide resin, polyamide-imide resin, polyether-ester resin, polyarylate resin, polyester resin, or polyester resin to which a reinforcing material is added.

The base may contain a filler to impart thermal conductivity or to increase durability.

The thickness of the base may be, for example, 50 μm or more and 150 μm or less.

A resin layer may be stacked on the base at a side opposite to the side at which the sliding layer is stacked.

The resin that forms the resin layer may be a fluorocarbon resin. More specifically, the resin may be, for example, non-cross-linked PTFE, cross-linked PTFE, perfluoroalkoxyalkane, or ethylene/tetrafluoroethylene copolymer.

The thickness of the resin layer may be, for example, 10 μm or more and 50 μm or less.

The sliding surface of the sliding sheet 111 (surface in contact with the fixing belt 110) and the surface of the sliding sheet 111 that is opposite the sliding surface (surface in contact with the pad member 112) are flat (surfaces without recesses). The surface roughness Ra of the sliding surface is 0.1 μm or more and 0.2 μm or less.

The surface roughness Ra is measured by using a surface roughness meter SURFCOM 1400A (manufactured by Tokyo Seimitsu Co., Ltd.) in compliance with JIS B0601-1994 under conditions that an evaluation length Ln is 4 mm, a reference length L is 0.8 mm, and a cutoff value is 0.8 mm. The surface roughnesses Ra of other components are similarly measured.

The thickness of the sliding sheet 111 may be, for example, 10 μm or more and 500 μm or less, and is preferably in the range of 10 μm to 300 μm.

The sliding sheet 111 is produced as follows. That is, powder of the cross-linked PTFE and powder of the other heat-resistant resin (for example, non-cross-linked PTFE) are put into a mold and compacted, and are burned at a temperature that is higher than or equal to the melting point of the resin to obtain a molded part. The molded part is subjected to post processing (for example, a skiving process in which the molded part is cut with a metal cutter to a desired thickness). Thus, the sheet is completed. In the case where an additive is to be contained in the sliding sheet 111, the sheet is produced by mixing powder of the cross-linked PTFE, powder of the other heat-resistant resin (for example, non-cross-linked PTFE), and the additive and then performing steps similar to the above-described steps.

A lubricant may be provided between the sliding sheet 111 and the fixing belt 110.

To suppress an increase in the drive torque of the fixing belt 110 and other components, the lubricant may contain amino-modified silicone oil and terminal-modified perfluoropolyether (hereinafter referred to as "terminal-modified PFPE").

The amino-modified silicone oil is a derivative of dimethylpolysiloxane in which amino group is introduced into dimethylpolysiloxane molecules.

The amino-modified silicone oil may be a compound in which silicon atoms in dimethylpolysiloxane molecules are combined with a substituent, which may be 2-aminoethyl group, 3-aminopropyl group, N-cyclohexyl-3-aminopropyl group, or N-(2-aminoethyl)-3-aminopropyl group. For example, KF-8009A, KF-8009B, or KF-8009C produced by Shin-Etsu Chemical Co., Ltd. may be used.

The kinetic viscosity (25° C.) of the amino-modified silicone oil may be, for example, 100 $mm^2/s$ or more and 600 $mm^2/s$ or less.

Although a single type of amino-modified silicone oil may be used, a mixture of two or more types of amino-modified silicone oils may instead be used.

The lubricant may contain silicone oil other than the amino-modified silicone oil (for example, dimethyl silicone oil or modified silicone oil other than the amino-modified silicone oil).

The content of the amino-modified silicone oil in the total amount of silicone oil may be 80 mass % or more, preferably 90 mass % or more, and more preferably, 100 mass %.

The terminal-modified PFPE is a derivative of perfluoropolyether in which a substituent is introduced into one or both of the terminals of perfluoropolyether (PFPE). The substituent may be, for example, amino group, hydroxyl group, carboxy group, or phosphate group.

The substituent may be introduced into one or both of the terminals of PFPE. For example, the substituent may be introduced into one terminal of PFPE.

From the viewpoint of compatibility with cross-linked PTFE resin, the terminal-modified PFPE may be terminal amino-modified PFPE or terminal alcohol-modified PFPE. In particular, terminal amino-modified PFPE is preferable.

The weight-average molecular weight of the terminal-modified PFPE may be 2000 or more and 5000 or less, and preferably 3000 or more and 4000 or less. When the weight-average molecular weight is 2000 or more, vaporization does not easily occur at high temperatures. When the weight-average molecular weight is 5000 or less, the terminal-modified PFPE may easily enter the cross-link structure of the cross-linked PTFE resin.

From the viewpoint of suppressing an increase in the drive torque due to repetition of the image fixing process, the content of the terminal-modified PFPE in the lubricant may be 0.05 mass % or more, preferably 0.1 mass % or more, and more preferably, 0.5 mass % or more. From the viewpoint of viscosity stability, the content may be 5.0 mass % or less, preferably 4.0 mass % or less, and more preferably, 3.0 mass % or less.

The lubricant may further contain other components, such as a commonly known antioxidant or thickener.

The lubricant is not limited to one having the above-described composition, and may instead be a commonly known lubricant.

The fixing belt 110 may have an inner peripheral surface (surface in contact with the sliding sheet 111) that is made of a heat-resistant resin (for example, thermosetting polyimide, thermoplastic polyimide, polyamide, or polyamide-imide). The surface roughness Ra of the inner peripheral surface may be 0.4 μm or more and 1.0 μm or less (preferably 0.6 μm or more and 0.8 μm or less).

The nip forming surface 113 (surface in contact with the sliding sheet 111) of the pad member 112 may be flat. More specifically, the surface roughness Ra of the nip forming surface 113 may be 0.1 μm or more and 0.8 μm or less (preferably 0.1 μm or more and 0.5 μm or less).

Pressure-Applying Roller: Fixing Device

The pressure-applying roller 104 is formed by stacking an elastic layer 104B made of silicone rubber and a release layer 104C made of a fluorocarbon resin, which is an example of a surface layer, on the outer periphery of a columnar rotating shaft 104A made of aluminum.

Figure 3A:
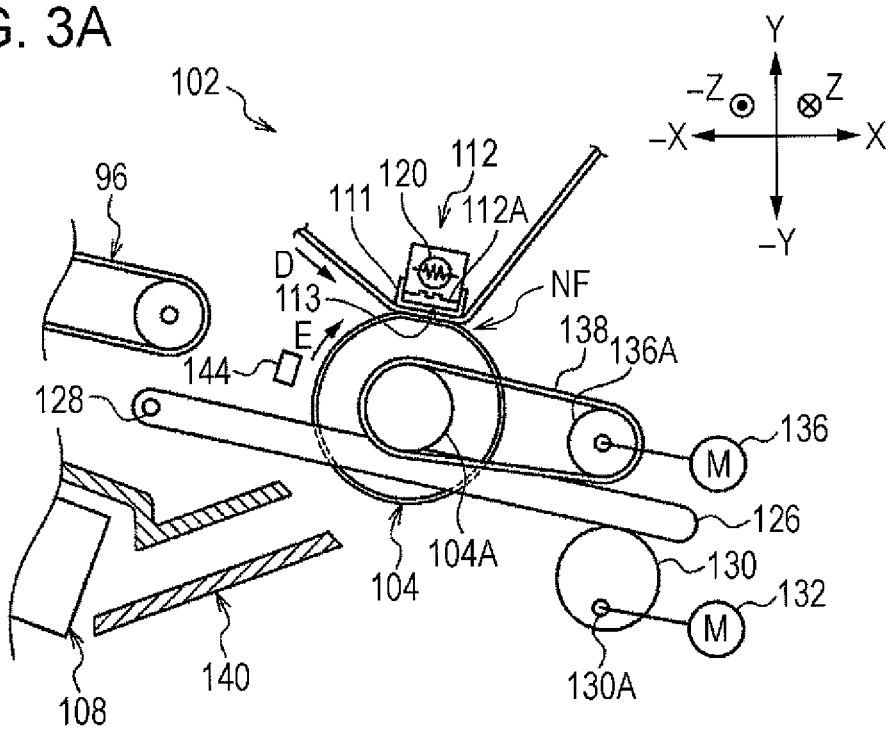
FIGS. 3A and 3B are side views of a region around a pressure-applying roller included in the fixing device according to the exemplary embodiment of the present invention.
Figure 3B:
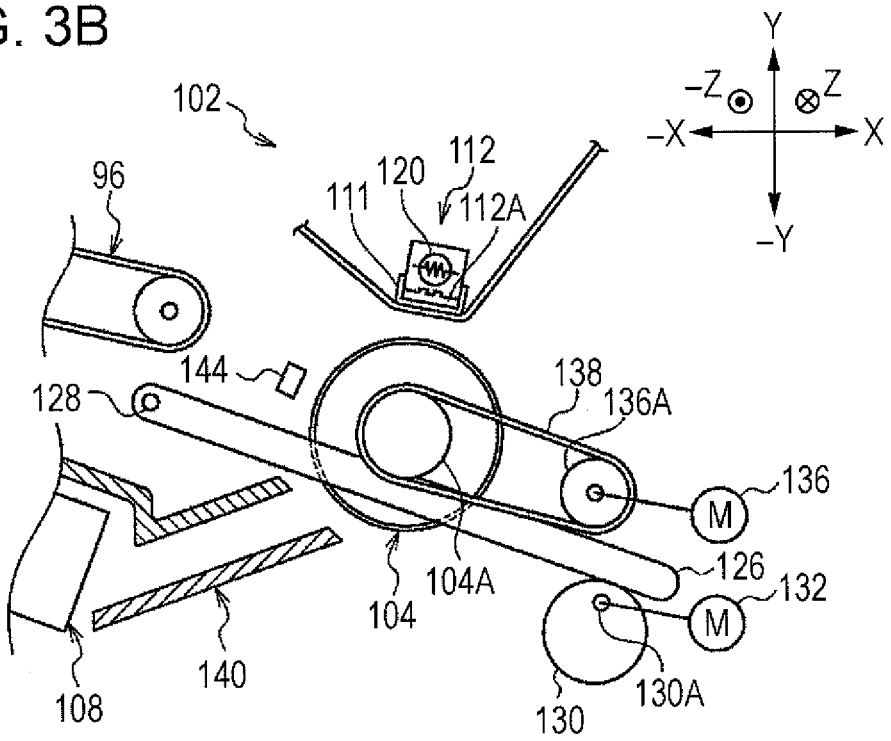

As illustrated in FIGS. 3A and 3B, bottom portions of both ends of the rotating shaft 104A (only one end is illustrated) are supported by central portions of respective support members 126 that extend in the X direction. A shaft member 128 whose axial direction is the Z direction is provided at the end of each support member 126 in the −x direction, and the support member 126 is rotatably supported by the shaft member 128.

An eccentric cam 130 is provided at the end of each support member 126 in the X direction. The support member 126 is supported by the outer peripheral surface of the eccentric cam 130 at the bottom surface thereof. The axial direction of a rotating shaft 130A of the eccentric cam 130 is the Z direction. A motor 132, which is a stepping motor, is provided to transmit a driving force (rotating force) to the rotating shaft 130A of the eccentric cam 130.

When the eccentric cam 130 is rotated, the pressure-applying roller 104 moves between a latch position (see FIG. 3A) at which the fixing nip NF is formed between the pressure-applying roller 104 and the fixing belt 110 and a standby position (see FIG. 3B) at which the pressure-applying roller 104 is separated from the fixing belt 110.

A motor 136 is provided to transmit a rotating force to the rotating shaft 104A of the pressure-applying roller 104 when the pressure-applying roller 104 is moved to the standby position. An endless timing belt 138 that transmits a rotating force is wrapped around an output shaft 136A of the motor 136 and the rotating shaft 104A. When the pressure-applying roller 104 is moved to the latch position, the transmission of the rotating force (driving force) from the motor 136 to the pressure-applying roller 104 is stopped and the pressure-applying roller 104 is rotated by the movement of the fixing belt 110 in the direction of arrow E illustrated in FIG. 3A.

Fan: Fixing Device

The fan 108 is, for example, a sirocco fan, and is located on the −Y direction side of (below) the transport belt 96, as illustrated in FIG. 4. A guide member 140 is provided to guide the airflow generated by the fan 108 toward the surface of the pressure-applying roller 104. A detection sensor 144 that detects the temperature of the surface of the pressure-applying roller 104, which receives the airflow blown from the fan 108, without contacting the surface is located on the −X direction side of the pressure-applying roller 104. In the present exemplary embodiment, the controller 20 (see FIG. 6) operates the fan 108 on the basis of the detection result obtained by the detection sensor 144 so that the surface temperature of the pressure-applying roller 104 is in the range of 70° C. or more and 80° C. or less.

Other Structures

Figure 1A:
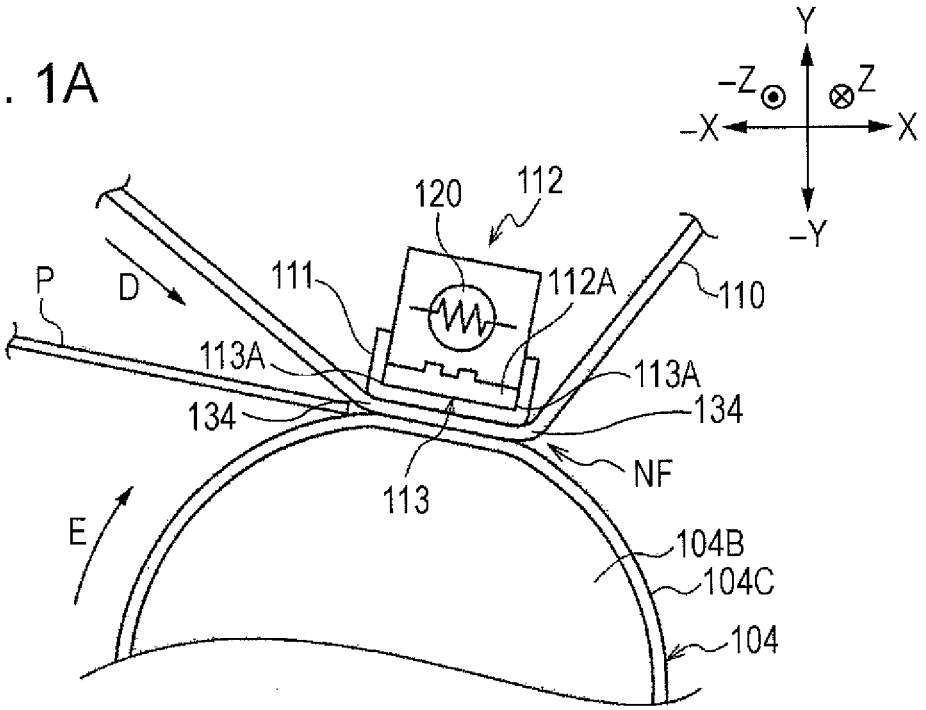
FIGS. 1A and 1B are enlarged side views illustrating a fixing nip portion of a fixing device according to an exemplary embodiment of the present invention.
Figure 1B:
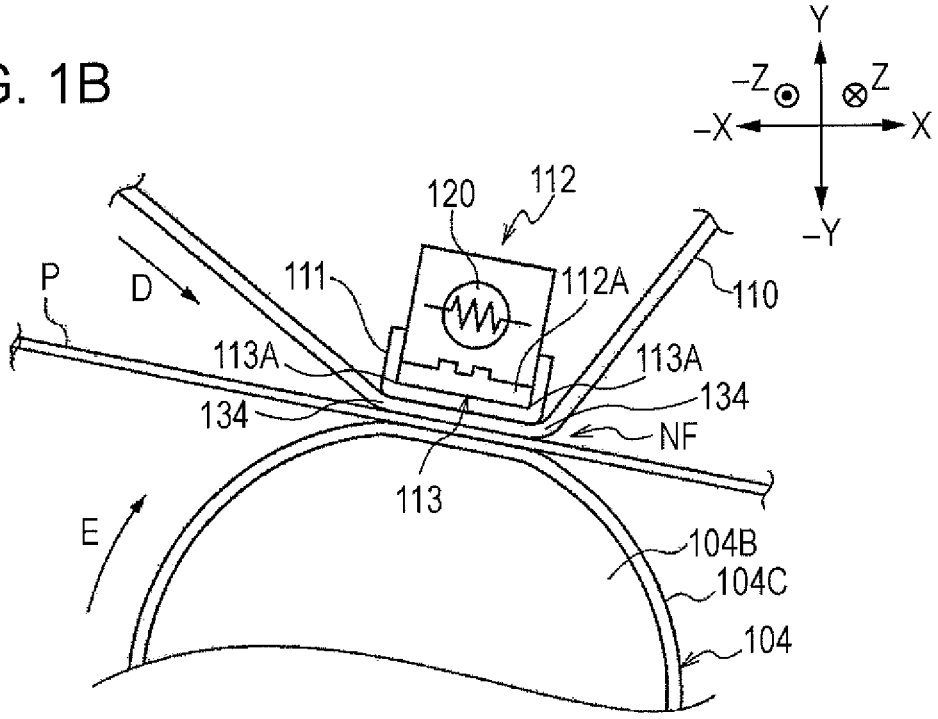

As described above, the nip forming surface 113 of the pad member 112 receives the nip load from the pressure-applying roller 104, so that the fixing nip NF is formed between the fixing belt 110 and the pressure-applying roller 104, as illustrated in FIGS. 1A and 1B. Since the nip forming surface 113 has corner portions 113A, the fixing nip NF has bent portions 134. The nip load for forming the nip forming surface 113 (nip load applied to the pad member 112 by the pressure-applying roller 104) may be set to, for example, 800 N or more and 4000 N or less.

Operation of Fixing Device

The operation of the fixing device 100 will now be described.

In the fixing device 100, as illustrated in FIG. 1A, the sheet member P onto which the toner images have been transferred enters the fixing nip NF formed between the fixing belt 110 that rotates and the pressure-applying roller 104 that rotates from the leading end thereof (right end in FIG. 1A). The sheet member P enters the fixing nip NF while the back surface of the sheet member P (surface facing the pressure-applying roller 104) is in contact with the release layer 104C of the pressure-applying roller 104 and the front surface of the sheet member P (surface facing the fixing belt 110) is in contact with the fixing belt 110.

The sheet member P that has entered the fixing nip NF is nipped between the fixing belt 110 that rotates and the pressure-applying roller 104 that rotates, and transported downstream in the transporting direction of the sheet member P (hereinafter referred to simply as the "transporting direction") (see FIG. 1B). When the sheet member P is being nipped and transported, the toner images are heated by the heating belt mechanism 102 and fixed to the sheet member P.

In the fixing device 100, the heating belt mechanism 102 includes, for example, the halogen lamp 120 and the fixing belt 110 is directly heated. In other words, in the fixing device 100, the heat source is provided in a belt mechanism which includes a belt member. When the heat source is provided in the belt mechanism, compared to the case in which the belt mechanism has no heat source, the temperature in a sliding region between the fixing belt 110 and the sliding sheet 111 more easily increases. Accordingly, the sliding resistance easily increases. As a result, creeping of the sliding sheet 111 easily occurs.

Since the sliding sheet 111 receives the driving force in the transporting direction (processing direction) of the sheet member P, when the sliding resistance increases, creeping occurs in such a manner that the sliding sheet 111 stretches in this direction. It is considered that the sliding sheet 111 does not stretch uniformly. For example, the sliding sheet 111 is considered to receive a large force and stretch nonuniformly in a region where the pressure between the pressure-applying roller 104 and the pad member 112 varies in the axial direction (Z direction) or in a region where a high pressure is applied, such as a region around the leading end of the sheet member P when the sheet member P is transported.

When the sliding sheet 111 stretches nonuniformly, in the case where the nip forming surface 113 of the pressing portion 112A of the pad member 112 has a recessed portion with a large radius of curvature, the sliding sheet 111 does not follow the pressing portion 112A (nip forming surface 113) of the pad member 112.

When the sliding sheet 111 does not follow the pressing portion 112A of the pad member 112, the sliding sheet 111 slacks and the slack portion of the sliding sheet 111 acts as if it has a large thickness. Accordingly, stress concentration occurs in this portion.

In the fixing process, the sheet member P receives nonuniform pressure, which may cause image defects (for example, uneven glossiness). When the variation in pressure is large, the sheet member P may become wrinkled.

In contrast, in the fixing device 100 in which the heat source is provided in the belt mechanism including the belt member, the sliding sheet 111 includes the sliding layer containing the cross-linked PTFE, the content of which in the resin contained in the layer is in the range of 25 mass % or more and 75 mass % or less, or approximately 25 mass % or more and approximately 75 mass % or less. Accordingly, the occurrence of creeping is reduced. When this sliding sheet 111 is used, sufficient followability may also be ensured.

The nip forming surface 113 of the pressing portion 112A of the pad member 112 includes the flat portion 112B (see FIG. 2A) or the recessed portion 112C (see FIG. 2B) having a radius of curvature of 100 mm or more or approximately 100 mm or more. Thus, even when the sliding sheet 111 stretches and creeping occurs, the risk that the sliding sheet 111 will not follow the pressing portion 112A (nip forming surface 113) of the pad member 112 is reduced. In other words, the sliding sheet 111 is caused to follow the pressing portion 112A (nip forming surface 113) of the pad member 112.

In the case where the sliding sheet 111 is formed of a single-layer body of a sliding layer containing the cross-linked PTFE in the range of 25 mass % or more and 75 mass % or less, or approximately 25 mass % or more and approximately 75 mass % or less, the adhesion between the sliding sheet 111 and the pad member 112 is increased. Therefore, the occurrence of creeping of the sliding sheet 111 is further reduced.

The sliding sheet 111 may be arranged such that both ends thereof in the width direction are fixed to the pad member 112 but a central portion thereof in the width direction is not fixed to the pad member 112. In other words, the sliding sheet 111 may be arranged such that a portion thereof corresponding to the nip forming surface 113 is simply in tight contact with the pad member 112. In this case, creeping of the sliding sheet 111 easily occurs. However, when the sliding sheet 111 is formed of a single-layer body of a sliding layer containing the cross-linked PTFE in the range of 25 mass % or more and 75 mass % or less, or approximately 25 mass % or more and approximately 75 mass % or less, the adhesion between the sliding sheet 111 and the pad member 112 is increased, so that the risk of creeping is reduced.

When the surface of the sliding sheet 111 that contacts the pad member 112 (surface at the side opposite to the side of the sliding surface) and the surface of the pad member 112 that contacts the sliding sheet 111 (nip forming surface 113) are flat, creeping of the sliding sheet 111 easily occurs. However, when the sliding sheet 111 is formed of a single-layer body of a sliding layer containing the cross-linked PTFE in the range of 25 mass % or more and 75 mass % or less, or approximately 25 mass % or more and approximately 75 mass % or less, the adhesion between the sliding sheet 111 and the pad member 112 is increased, so that the risk of creeping is reduced.

When the sliding surface of the sliding sheet 111 is flat, the sliding resistance of the sliding sheet 111 with respect to the fixing belt 110 increases and creeping of the sliding sheet 111 easily occurs. However, when the sliding sheet 111 includes a sliding layer containing the cross-linked PTFE in the range of 25 mass % or more and 75 mass % or less, or approximately 25 mass % or more and approximately 75 mass % or less, the risk of creeping is reduced.

In addition, when the halogen lamp 120 (heat source) is disposed in the pad member 112 having the nip forming surface 113 (that is, in the pressing member), the temperatures of the fixing belt 110 and the sliding sheet 111 increase. Accordingly, the sliding resistance easily increases, and creeping of the sliding sheet 111 easily occurs. However, when the sliding sheet 111 includes a sliding layer containing the cross-linked PTFE in the range of 25 mass % or more and 75 mass % or less, or approximately 25 mass % or more and approximately 75 mass % or less, the risk of creeping is reduced.

Although an exemplary embodiment of the present invention has been described in detail, the present invention is not limited to the exemplary embodiment, and it is obvious to a person skilled in the art that various embodiments are possible within the scope of the present invention. A fixing device according to an exemplary embodiment of the present invention is not particularly limited as long as the fixing device includes a heating member that heats a toner image formed on a recording medium and that includes a rotatable belt member, a heat source, a pressing member disposed inside the belt member to press the belt member against a pressure-applying member, and a sliding sheet disposed between the belt member and the pressing member; the pressure-applying member that presses the recording medium against the belt member and that rotates in response to rotation of the belt member to transport the recording medium while nipping the recording medium between itself and the belt member, the sliding sheet being formed of a single-layer body containing cross-linked PTFE whose degree of cross linking is in the range of 25 mass % or more and 75 mass % or less, or approximately 25 mass % or more and approximately 75 mass % or less.

EXAMPLES

The present invention will now be explained in further detail by way of examples. These examples are not intended to limit the scope of the present invention.

Production of Sliding Sheets

Sliding Sheet (0)

Powder of non-cross-linked PTFE is put into a mold and compacted, and is burned at a temperature that is higher than or equal to the melting point of the resin to obtain a molded part. This molded part is subjected to a skiving process using a metal cutter to produce a sliding sheet (0) having a length of 374 mm, a width of 46 mm, and a thickness of 130 μm or more and 140 μm or less. The surface roughness Ra of the sliding surface of the sliding sheet (0) and that of the surface at the opposite side are in the range of 0.1 μm or more and 0.2 μm or less.

Sliding Sheet (1)

Mixture of powder of cross-linked PTFE and powder of non-cross-linked PTFE (trade name XF-1A, manufactured by Hitachi Cable, Ltd., in which the content of the powder of cross-linked PTFE is 10 mass %) is put into a mold and compacted, and is burned at a temperature that is higher than or equal to the melting point of the resin to obtain a molded part. This molded part is subjected to a skiving process using a metal cutter to produce a sliding sheet (1) having a length of 374 mm, a width of 46 mm, and a thickness of 130 μm or more and 140 μm or less. The surface roughness Ra of the sliding surface of the sliding sheet (1) and that of the surface at the opposite side are in the range of 0.1 μm or more and 0.2 μm or less.

Sliding Sheet (2)

A sliding sheet (2) is produced by a process similar to the production process of the sliding sheet (1) except that the content of the powder of cross-linked PTFE in the mixture of the powder of cross-linked PTFE and the powder of non-cross-linked PTFE is changed to 25 mass %.

Sliding Sheet (3)

A sliding sheet (3) is produced by a process similar to the production process of the sliding sheet (1) except that the content of the powder of cross-linked PTFE in the mixture of the powder of cross-linked PTFE and the powder of non-cross-linked PTFE is changed to 50 mass % (trade name XF-1B, manufactured by Hitachi Cable, Ltd.).

Sliding Sheet (4)

A sliding sheet (4) is produced by a process similar to the production process of the sliding sheet (1) except that the content of the powder of cross-linked PTFE in the mixture of the powder of cross-linked PTFE and the powder of non-cross-linked PTFE is changed to 75 mass.

Sliding Sheet (5)

A sliding sheet (5) is produced by a process similar to the production process of the sliding sheet (1) except that the content of the powder of cross-linked PTFE in the mixture of the powder of cross-linked PTFE and the powder of non-cross-linked PTFE is changed to 80 mass %.

Examples 1 to 4 and Comparative Examples 1 and 2

Each of the sliding sheets is attached to a fixing device having the same structure as that of the fixing device illustrated in FIG. 4 (fixing device in which a pad member and a pressure-applying roller are pressed against each other so that a nip forming surface of a pressing portion of the pad member has a flat portion (see FIG. 2A)). The evaluations described below are performed by using this fixing device. Processability and formability of PTFE sheets used to produce the sliding sheets are also evaluated. The results are shown in Table 1.

In this fixing device, each sliding sheet is attached to the pad member such that both ends of the sliding sheet are retained by retaining plates, and the surface roughness Ra of a surface of the pad member that contacts the sliding sheet is 0.3 μm. The fixing belt is an endless belt in which a tetrafluoroethylene/perfluoroalkylvinylether copolymer tube covers the outer peripheral surface of a layered body in which an elastic layer is formed on a base polyimide layer. The base polyimide layer has a thickness of 80 μm. The elastic layer is made of silicone rubber with a hardness of 35(A), and has a thickness of 300 μm. The surface roughness Ra of the inner peripheral surface of the fixing belt is 0.3 μm. The nip load applied by the pressure-applying roller to the pad member is set to 1500 N. A lubricant is applied between the fixing belt and the sliding sheet.

Evaluation

Creep Resistance of Sliding Sheets

To evaluate the creep resistance of each sliding sheet, a fixing test is carried out in which transportation of sheet members is performed for 120 hours while the temperature of the fixing belt is set to 180° C. and while the pressure-applying roller is repeatedly positioned at the latch position (see FIG. 3A) for 160 seconds and at the standby position (see FIG. 3B) for 15 seconds. Then, fixing of a solid image is performed and whether or not there are image defects is visually checked.

Evaluation criteria are as follows:

Good: No image defects are observed.

Normal: Some image defects are observed, but the image defects do not cause any problem in practical application.

Bad: Image defects that cause problems in practical application are observed.

Processability of PTFE Sheets

To evaluate the processability of each PTFE sheet, the molded parts obtained in the process of producing the sliding sheets of the respective examples (molded parts that are not yet subjected to the skiving process using a metal cutter) are observed.

Evaluation criteria are as follows:

Good: No cracks are observed.

Fair: No cracks are observed, but there is a portion in which recesses are formed (usable after removing that portion).

Bad: Cracks are observed.

Formability of PTFE Sheets

To evaluate the formability of each PTFE sheet, the molded parts that are being subjected to the skiving process are visually observed in the process of producing the sliding sheets of the respective examples.

Evaluation criteria are as follows:

Excellent: Breakage is not observed, and the skiving process is performed in a short time.

Very Good: Breakage is not observed, but the time required for the skiving process is longer than that in the case of "Excellent".

Good: Breakage is not observed, but the time required for the skiving process is longer than that in the case of "Very Good".

Fair: Breakage is observed, but the breakage does not cause any problem in practical application.

Bad: Breakage is observed.

TABLE 1

| | | Comparative Example 1 | Comparative Example 2 | Example 1 | Example 2 | Example 3 | Example 4 |
|---|---|---|---|---|---|---|---|
| Sliding Sheet | No. | (0) | (1) | (2) | (3) | (4) | (5) |
| | Content of Cross-Linked PTFE | 0 mass % | 10 mass % | 25 mass % | 50 mass % | 75 mass % | 80 mass % |
| Creep Resistance | | Bad | Bad | Fair | Good | Good | Good |
| PTFE Sheet Processability | | Good | Good | Good | Good | Fair | Bad |
| PTFE Sheet Formability | | Excellent | Excellent | Very Good | Good | Fair | Bad |

It is clear from the above results that, according to the examples, the results of evaluation of the creep resistance may be improved from those of the comparative examples while ensuring sufficient processability and formability of the PTFE sheets for producing the sliding sheets.

Examples 11 to 16 and Comparative Example 11

Each of the sliding sheets is attached to a fixing device having the same structure as that of the fixing device illustrated in FIG. 4 (fixing device in which a pad member and a pressure-applying roller are pressed against each other so that a nip forming surface of a pressing portion of the pad member has a recessed portion (see FIG. 2B).

Settings are changed so that the recessed portion of the nip forming surface of the pressing portion included in the pad member has a radius of curvature as shown in Table 2, and the evenness of glossiness is evaluated. The fixing device is similar to that of Example 1 except for this condition.

Evaluation of Evenness of Glossiness

To evaluate evenness of glossiness, a fixing test is carried out in which transportation of sheet members is performed for 120 hours while the temperature of the fixing belt is set to 180° C. and while the pressure-applying roller is repeatedly positioned at the latch position (see FIG. 3A) for 160 seconds and at the standby position (see FIG. 3B) for 15 seconds. Then, fixing of a solid image is performed and whether or not there is an unevenness of glossiness is visually checked.

Evaluation criteria are as follows:

Good: No uneven glossiness is observed.

Fair: Uneven glossiness is observed, but the uneven glossiness does not cause any problem in practical application.

Bad: Uneven glossiness that causes problems in practical application is observed.

TABLE 2

| | | Comparative Example 11 | Example 11 | Example 12 | Example 13 | Example 14 | Example 15 | Example 16 |
|---|---|---|---|---|---|---|---|---|
| Sliding Sheet | No. | (3) | (3) | (3) | (3) | (3) | (3) | (3) |
| | Content of Cross-Linked PTFE | 50 mass % | 50 mass % | 50 mass % | 50 mass % | 50 mass % | 50 mass % | 50 mass % |
| Radius of Curvature of Recessed Portion of Nip Forming Surface of Pressing Portion Included in Pad Member | | 50 mm | 100 mm | 130 mm | 160 mm | 200 mm | 500 mm | 1000 mm |
| Evenness of Glossiness | | Bad | Fair | Good | Good | Good | Good | Good |

It is clear from the above results that, according to the examples, the results of evaluation regarding uneven glossiness due to creeping of the sliding sheets are better than those of the comparative examples.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating member that heats a toner image formed on a recording medium, the heating member including a rotatable belt member, a heat source, and a pressing member that is disposed inside the belt member and that presses the belt member against a pressure-applying member, wherein a surface of the pressing member that opposes an inner peripheral surface of the belt member, with a sliding sheet interposed therebetween, includes a flat portion or a recessed portion having a radius of curvature of approximately 100 mm or more, wherein the sliding sheet includes a sliding layer containing cross-linked polytetrafluoroethylene, the content of the cross-linked polytetrafluoroethylene in resin contained in the sliding layer being approximately 35 mass % or more and approximately 65 mass % or less, and wherein the pressure-applying member presses the recording medium against the belt member and rotates in response to rotation of the belt member to transport the recording medium while nipping the recording medium between the pressure-applying member and the belt member.

2. An image forming apparatus comprising:

a transfer unit that transfers a toner image onto a recording medium; and the fixing device according to claim 1, the fixing device fixing the toner image transferred onto the recording medium by the transfer unit to the recording medium.

* * * * *